United States Patent [19]

Ishikawa

[11] Patent Number: 4,793,301

[45] Date of Patent: Dec. 27, 1988

[54] LUBRICATING SYSTEM FOR AN INTERNAL COMBUSTION ENGINE

[75] Inventor: Tadashi Ishikawa, Urawa, Japan

[73] Assignee: Fuji Jukogyo Kabushiki Kaisha, Tokyo, Japan

[21] Appl. No.: 135,590

[22] Filed: Dec. 21, 1987

[30] Foreign Application Priority Data

Dec. 25, 1986 [JP] Japan ..... 61-201932[U]
Dec. 25, 1986 [JP] Japan ..... 61-201936[U]

[51] Int. Cl.[4] ..... F01M 1/00
[52] U.S. Cl. ..... 123/196 R; 123/192 B; 184/6.5
[58] Field of Search ..... 123/196 R, 192 R, 192 B; 184/6.5

[56] References Cited

U.S. PATENT DOCUMENTS 4,023,547 5/1977 Reisachev ..... 123/196 R
4,622,933 11/1986 Fukuo et al. ..... 123/196 R
4,729,349 3/1988 Sonoda et al. ..... 123/196 R

FOREIGN PATENT DOCUMENTS 60-42161 12/1985 Japan .

*Primary Examiner*—E. Rollins Cross
*Attorney, Agent, or Firm*—Martin A. Farber

[57] ABSTRACT

A cover is secured to a crankcase of an engine to form a part of the crankcase. The crankshaft is supported by bearings provided in the cover and the crankcase. An oil passage is provided in the crankcase and cover and extending from an opening at a bottom of the crankcase to an inlet of an oil pump. Further, oil passages are provided in the cover and crankshaft extending from an outlet of oil pump to openings which open to the bearings for the crankshaft.

4 Claims, 6 Drawing Sheets

LUBRICATING SYSTEM FOR AN INTERNAL COMBUSTION ENGINE

BACKGROUND OF THE INVENTION

The present invention relates to a lubricating system for an internal combustion engine, and more particularly to a system for lubricating bearings of a crankshaft of the engine.

Japanese Utility Model Publication No. 60-42161 discloses a lubricating system for bearings of a crankshaft in which an oil passage is provided passing in the crankshaft and a crankpin and oil is ejected in a direction parallel with axis of the crankshaft and sprayed onto a side of each bearing. In such a system, a complicated oil passage must be provided for supplying lubricating oil to the passage in the crankshaft.

SUMMARY OF THE INVENTION

The object of the present invention is to provide a lubricating system in which an oil passage for supplying oil to bearings may be simplified in construction.

In accordance with the present invention, the lubricating system is characterized in that an oil passage is formed in a cover which is provided as a part of a crankcase, thereby simplifying the construction of the oil passage.

According to the present invention, there is provided a lubricating system for an internal combustion engine having at least one cylinder, crankcase, a crankshaft, a balancer shaft rotated by the crankshaft through gears, and an oil pump.

The system comprises a cover secured to the crankcase to form a part of the crankcase, the crankshaft being supported by a first bearing provided in the cover and by a second bearing provided in the crankcase, a first oil passage provided in the crankcase and cover and extending from an opening at a bottom of the crankcase to an inlet of the oil pump, a second oil passage provided in the cover and extending from an outlet of the oil pump to a first opening which opens to a journal of the crankshaft, a third oil passage provided in the crankshaft and extending from a second opening corresponding to the first opening to third openings which open to the first and second bearings and to connecting rods at crankpins of the crankshaft.

In an aspect of the invention, a fourth oil passage is provided in the cover and extending from the outlet of the oil pump to a fourth opening which opens to the gears on the balancer shaft, and a check valve is provided in the third oil passage adjacent the nozzle for the first bearing.

The other objects and features of this invention will be apparently understood from the following description with reference to the accompanying drawings.

DETAILED DESCRIPTION OF THE PREFERRED EMBODIMENT

Figure 1:
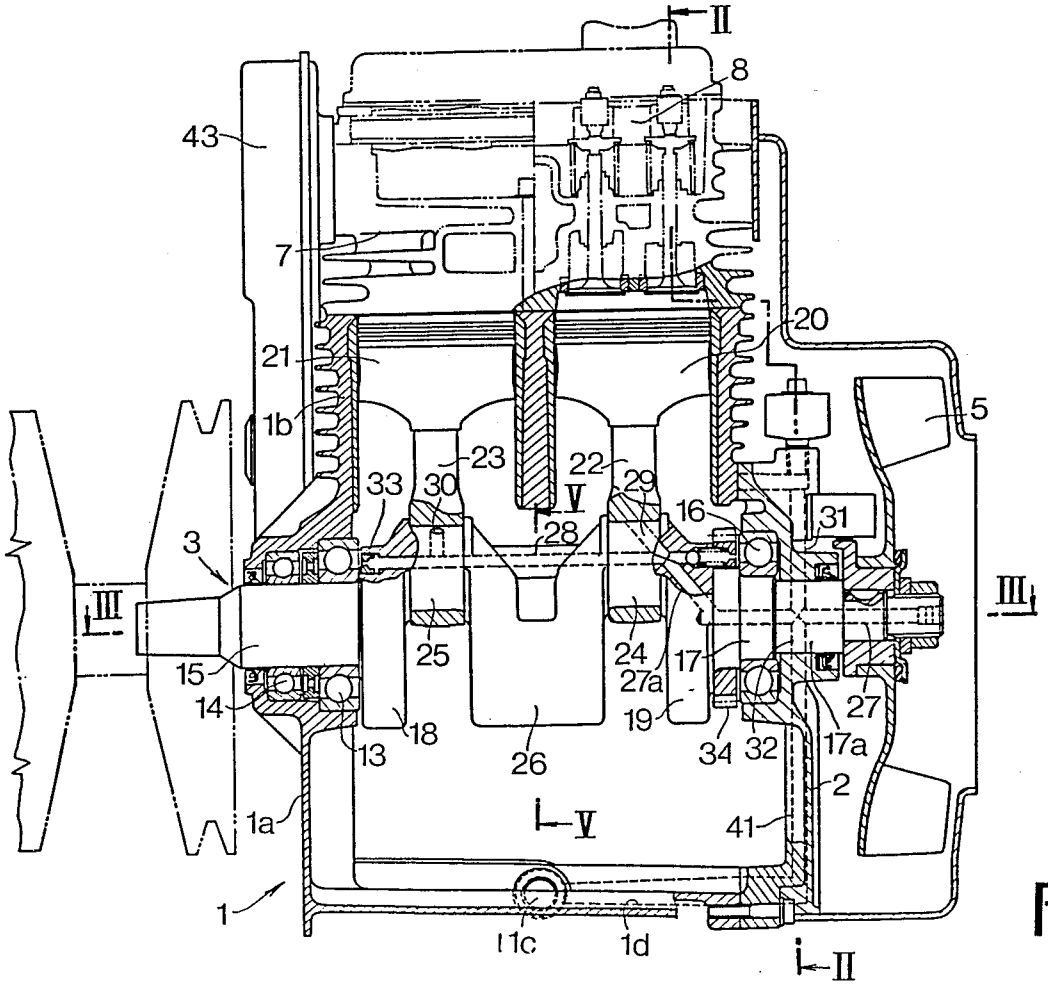
FIG. 1 is a sectional view of an aircooled engine to which the present invention is applied.

Referring to FIG. 1, an aircooled, two-cylinder engine has a case body 1 comprising a crankcase 1*a* and a pair of cylinders 1*b* integral with the crankcase 1*a*, and a cover 2 serves as a part of the crankcase 1*a*. A crankshaft 3 is supported by the crankcase 1*a* and the cover 2 through a main bearing 13, sub-bearing 14 and main bearing 16, respectively. Secured to one end of the crankshaft 3 is a pulley for transmitting engine power and securely mounted on the other is a cooling fan 5 made of synthetic resin for producing air current.

The crankshaft 3 has a journal 15 supported by bearings 13, 14, a journal 17 supported by bearing 16, webs 18, 19 adjacent the journals 15, 17, first and second crank pins 24, 25 for connecting rods 22, 23 of first and second pistons 20, 21, and a web 26 between crankpins 24, 25.

Figure 3:
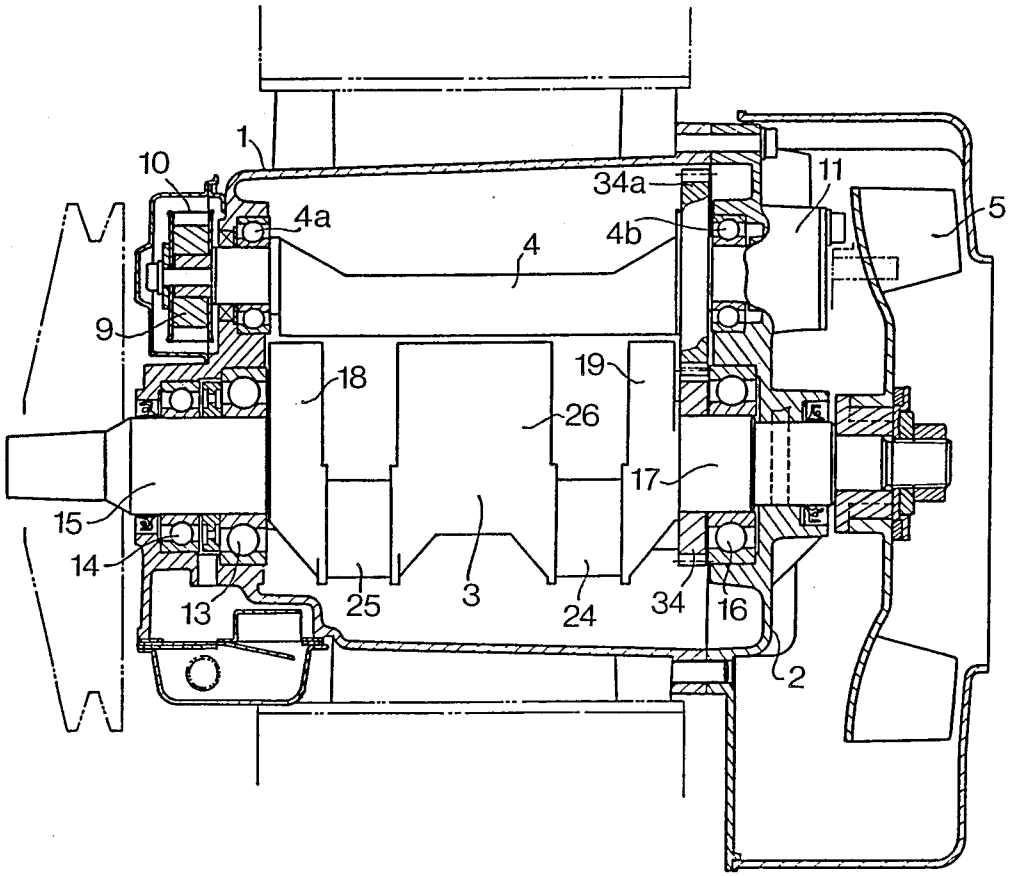
FIG. 3 is a sectional view taken along a line III—III of FIG. 1.
Figure 4:
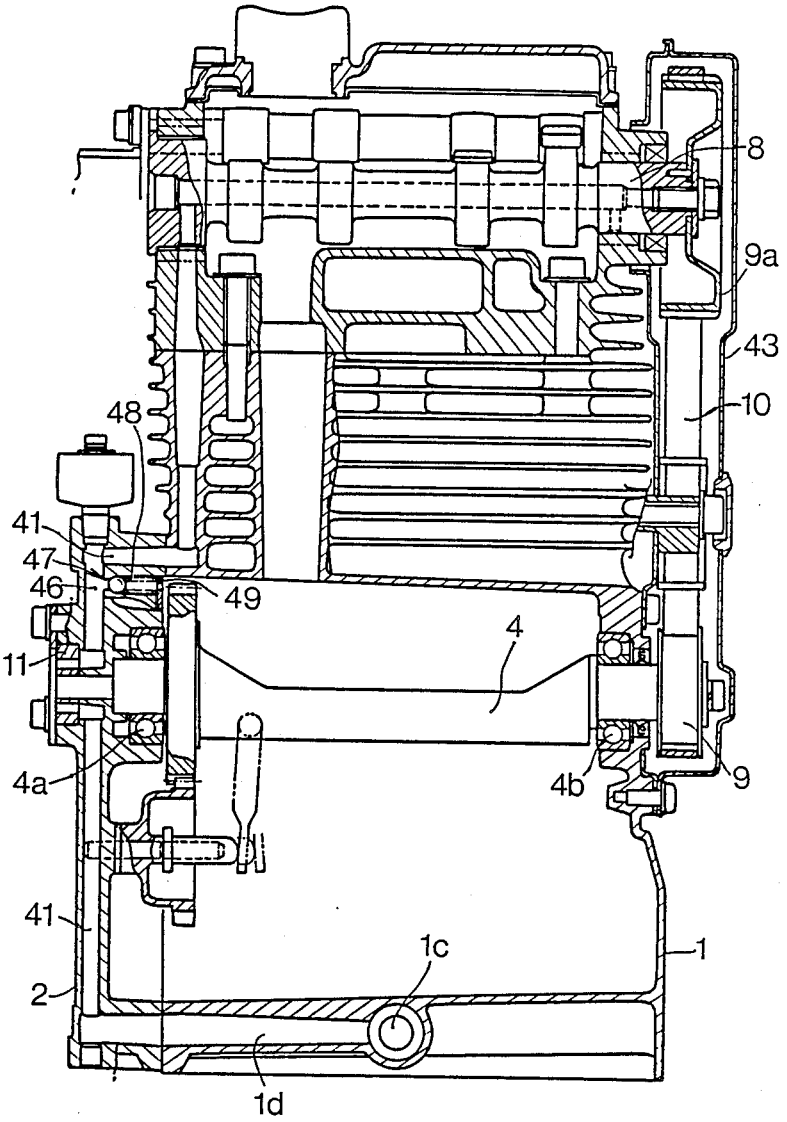
FIG. 4 is a sectional view taken along a line IV—IV of FIG. 2.
Figure 5:
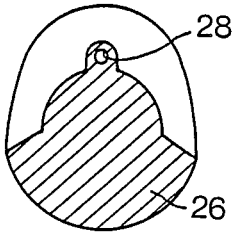
FIG. 5 is a sectional view taken along a line V—V of FIG. 1.

As shown in FIGS. 3 and 4, a balancer shaft 4 is supported by bearings 4*a* and 4*b* provided in the crankcase 1*a* and the cover 2. A drive gear 34 (FIG. 1), which is securely mounted on the crankshaft 3 between the main bearing 16 and the web 19, meshes with a driven gear 34*a* securely mounted on the balancer shaft 4 so as to rotate the balancer shaft 4. The balancer shaft 4 is connected to a camshaft 8 mounted in a cylinder head 7 through a drive pulley 9 disposed at the opposite end of the balancer shaft 4 to the gear 34*a*, driven pulley 9*a* at an end of the camshaft 8, and a timing belt 10 running on the pulleys (FIG. 4). The pulleys 8, 9 and timing belt 10 are covered by a belt cover 43.

Figure 2:
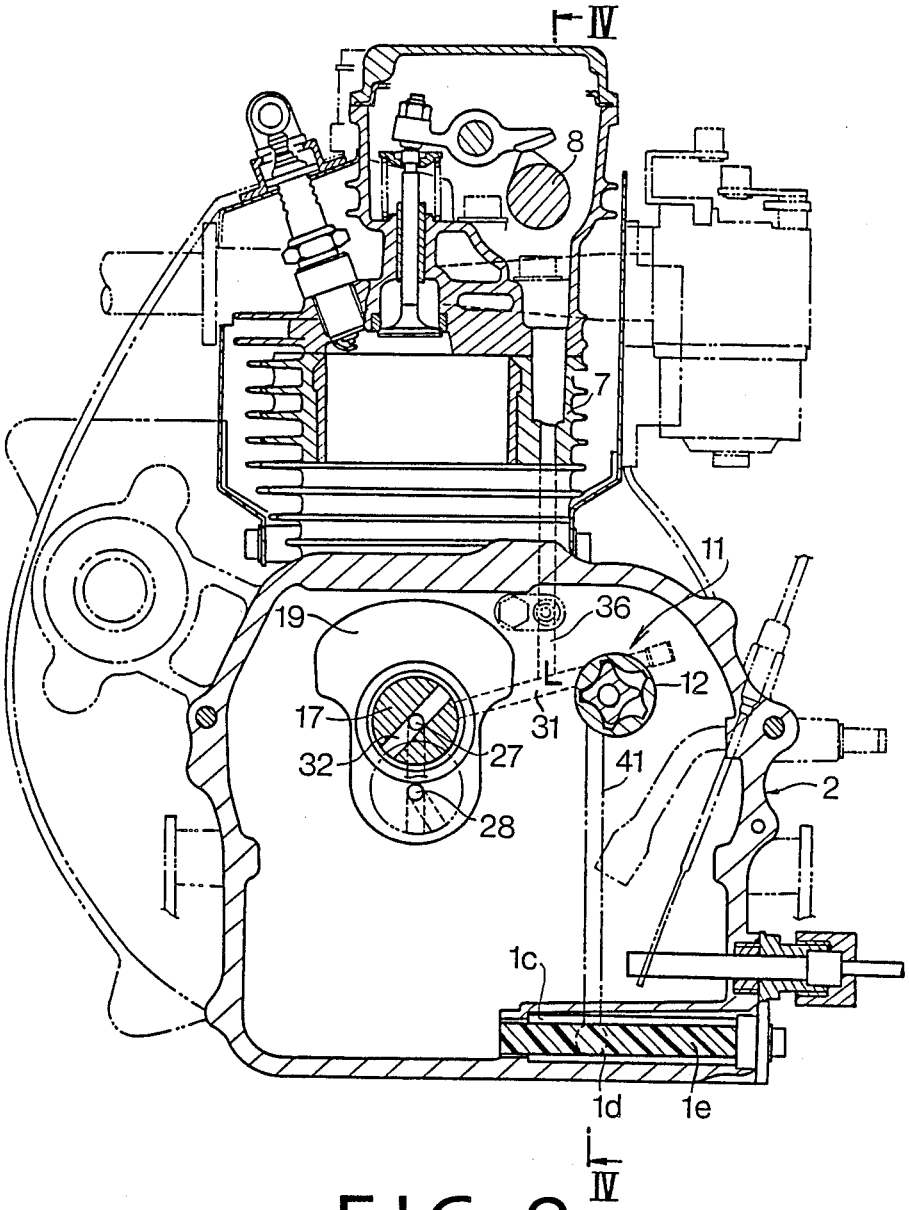
FIG. 2 is a sectional view taken along a line II—II of FIG. 1.

Referring to FIGS. 2, 3 and 4, a rotor 12 of an oil pump 11 is secured to the end of the balancer shaft 4 adjacent the gear 34*a*.

A first oil gallery 27 is formed in the journal 17 and an oblique passage 27*a* communicated with the oil gallery 27 is formed in the web 19 and crankpin 24 and opened to a big-end of the connecting rod 22 at an opening 29. A second oil gallery 28 is provided extending in the web 19, crankpin 24, web 26, crankpin 25 and web 18. The second oil gallery 28 intersects and intercommunicates with the oblique passage 27*a*. The second oil gallery 28 opens to a big-end of the connecting rod 23 at an opening 30 in the crankpin 25.

Figure 6:
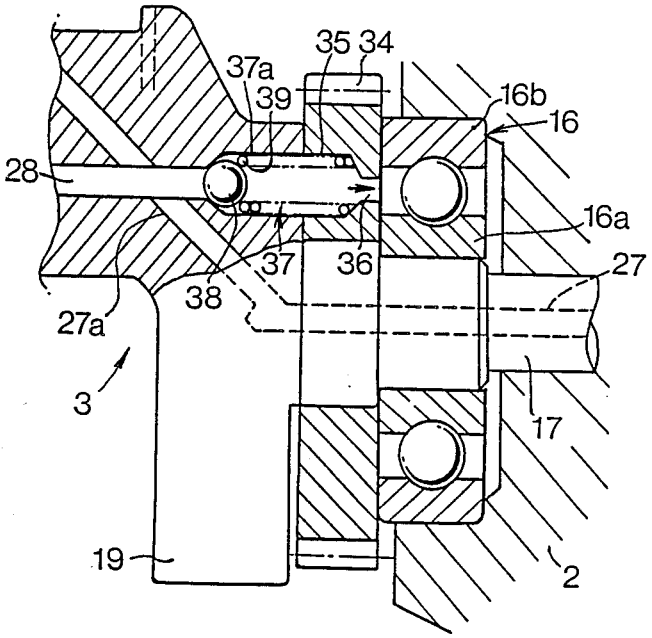
FIG. 6 is an enlarged view of a part of FIG. 1.

As shown in FIG. 6, a large diameter passage 37*a* is formed in the web 19 to communicate with the second oil gallery 28 and extended into the gear 34. A ball 38 is urged by a spring 39 to close the open end of the oil gallery 28, thereby forming a check valve 37. The passage 37*a* is communicated with a nozzle 36 which opens to a side of the bearing 16 at a space between inner and outer rings 16*a* and 16*b* thereof. As shown in FIG. 1, at the other end of the second oil gallery 28, a nozzle 33 is provided in the gallery to open to a side of the bearing 13 like the nozzle 36.

Referring to FIGS. 1, 2 and 4, crankcase 1*a* has an oil passage 1*c* opening to oil reservoir in the crankcase and an oil passage at the bottom thereof. The cover 2 has a vertical oil passage 41 communicated with the passage 1*d* and with an inlet of the oil pump 11. An outlet of the oil pump 11 is connected to a passage 31 formed in the cover 2 and opening to the journal 17. In the journal 17, a radial passage 32 communicated with the first oil gallery is provided to communicate with the passage 31 at every 180 degrees rotation of the crankshaft.

Figure 7:
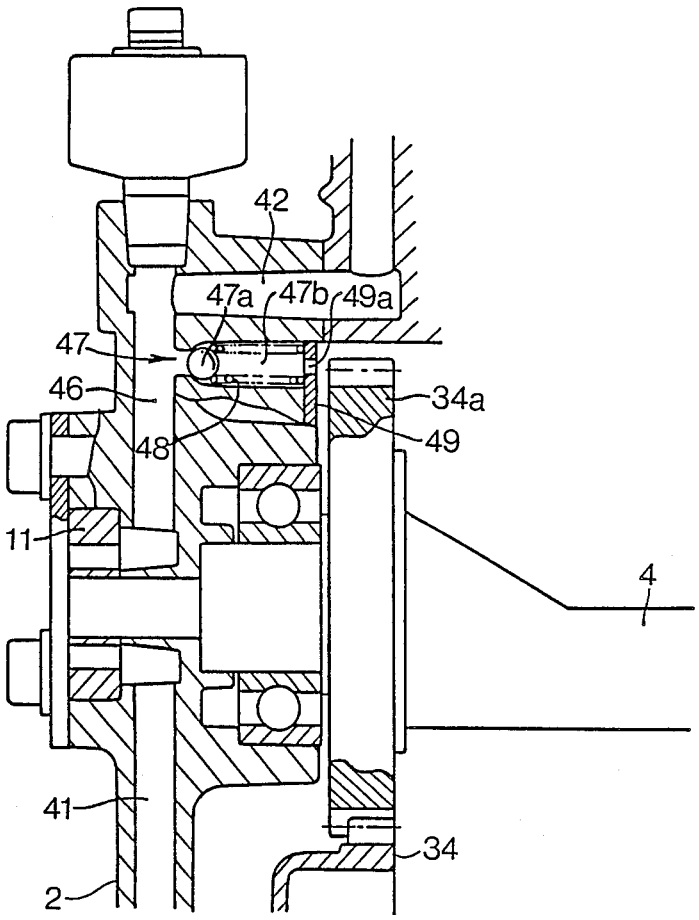
FIG. 7 is an enlarged view of a part of FIG. 4.

The passage 31 is further connected to a passage 46 formed in the cover 2. As shown in FIG. 7, the passage 46 is connected to a check valve 47 comprising a passage 47*b* formed in the cover 2, extending in parallel with the axis of the crankshaft 3, and a ball 47*a* urged by a spring 48. The passage 47*b* is connected to a nozzle 49*a* formed in a plate 49 secured to the cover 2. The nozzle 49*a* is provided to open to a side of the gear 34*a* of the balancer shaft 4 at the teeth thereof. A passage 42 connected to the passage is provided to lubricate the camshaft 8.

In operation, when the balancer shaft 4 is rotated by the crankshaft 3, the oil pump 11 is driven by the balancer shaft 4. Thus, oil in the il reservoir is drawn into the oil pump 11 through the passages 1*c*, 1*d* and an oil filter le and passage 41. The oil discharged from the oil pump passes to the second oil gallery 28 passing through passage 31 in the cover and, passage 32 and first oil gallery 27 in the journal 17, and passage 27*a*, and flows out from openings 29 and 30 to lubricate crankpins 24, 25 and connecting rods 22, 23. The oil is also ejected from the nozzle to the bearing 13 to lubricate it. When pressure of oil in the second oil gallery 28 exceeds a set value, the oil passes the check valve 37 and is ejected from the nozzle 36, thereby lubricating the bearing 16. Further, the oil passes through the passage 46 and the check valve 47 and is ejected from the nozzle 49*a* to the gear 34*a*, so that the teeth of the gears 34*a* and 34 are lubricated. Thus, one of the check valves 37, 47 acts also as a relief valve for the oil pump 11.

While the presently preferred embodiment of the present invention has been shown and described, it is to be understood that this disclosure is for the purpose of illustration and that various changes and modifications may be made without departing from the spirit and scope of the invention as set forth in the appended claims.

What is claimed is:

1. A lubricating system for an internal combustion engine having at least one cylinder, crankcase, a crankshaft, a balancer shaft rotated by said crankshaft through gears, and an oil pump, comprising:

a cover secured to said crankcase to form a part of the crankcase, said crankshaft being supported by a first bearing provided in said cover and by a second bearing provided in said crankcase;

a first oil passage provided in said crankcase and cover and extending from an opening at a bottom of the crankcase to an inlet of said oil pump;

a second oil passage provided in said cover and extending from an outlet of said oil pump to a first opening which opens to a journal of said crankshaft;

a third oil passage provided in said crankshaft and extending from a second opening corresponding to said first opening to third openings which open to said first and second bearings and to connecting rods at crankpins of said crankshaft.

2. The lubricating system according to claim 1 further comprising a fourth oil passage provided in said cover and extending from said outlet of said oil pump to a fourth opening which opens to said gears on said balancer shaft.

3. The lubricating system according to claim 1 wherein said third openings includes nozzles for said first and second bearings.

4. The lubricating system according to claim 3 further comprising a check valve provided in said third oil passage adjacent said nozzle for said first bearing.

* * * * *